United States Patent [19]

Berger et al.

[11] 4,106,688

[45] Aug. 15, 1978

[54] MATING BLANKS

[76] Inventors: Walter S. Berger, Overland Park; Andrew Paul Erhart, Lawrence, both of Kans.; William O. Fee, Raytown, Mo.; Darwin Lester Holtgren, Shawnee, Kans.; Burd & Fletcher Company, Kansas City, Mo.

[21] Appl. No.: 818,146

[22] Filed: Jul. 22, 1977

Related U.S. Application Data

[63] Continuation of Ser. No. 693,365, Jun. 7, 1976, abandoned.

[51] Int. Cl.[2] ..... B65D 5/11

[52] U.S. Cl. ..... 229/39 R; 229/DIG. 9

[58] Field of Search ..... 229/36, 39 R, 35, DIG. 9

[56] References Cited

U.S. PATENT DOCUMENTS

| | | | |
|---|---|---|---|
| 1,634,596 | 7/1927 | Schurmann | 229/DIG. 9 |
| 1,963,626 | 6/1934 | Lewandowski | 229/36 |
| 2,076,065 | 4/1937 | Clark | 229/36 |
| 2,435,283 | 2/1948 | Lighter | 229/36 |
| 3,112,854 | 12/1963 | Persson | 229/36 |
| 3,539,093 | 11/1970 | Massengill | 229/DIG. 9 |
| 3,985,287 | 10/1976 | Stetler | 229/DIG. 9 |
| 4,003,516 | 1/1977 | Commerford et al. | 229/DIG. 9 |

*Primary Examiner*—William Price

*Assistant Examiner*—Joseph M. Moy

*Attorney, Agent, or Firm*—Schmidt, Johnson, Hovey & Williams

[57] ABSTRACT

A unitary, die cut carton blank is provided which is foldable to present a box-type ice cream carton fillable with conventional filling equipment and which is especially configured for permitting fabrication of a plurality of blanks from master sheets with significant material savings and full use of printing equipment. The blanks hereof include generally rectangular top, rear, bottom and front panel sections each having oppositely extending side marginal closure flaps, with the front panel closure flaps and male locking flaps being especially configured to conform with corresponding areas of identical blanks placed in juxtaposed and catercorner relationship to the first blank in order to permit layout and cutting of a maximum number of blanks per unit area of master sheet material to thereby lessen the amount of sheet material required in the production of the blanks. In preferred forms the outermost relieved end margins of the front closure flaps are generally L-shaped in configuration, but in other instances these relieved areas may present scalloped or obliquely cut outer margins. The locking lobes of the male locking flaps are also preferably relieved for permitting full abutting contact between side-by-side blanks.

7 Claims, 4 Drawing Figures

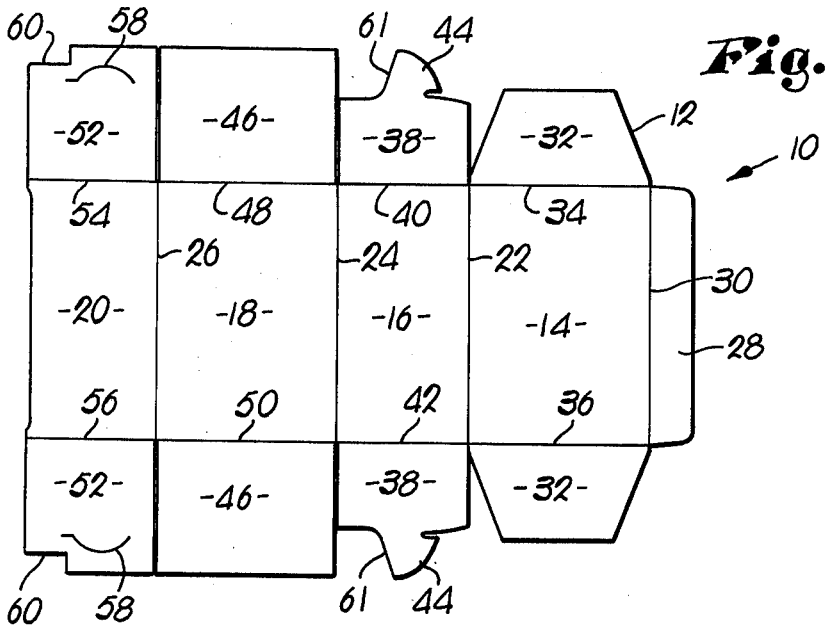
Fig.1.
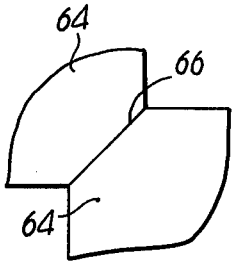
Fig.3.
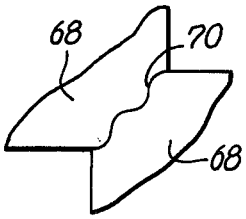
Fig.4.
Fig.2.
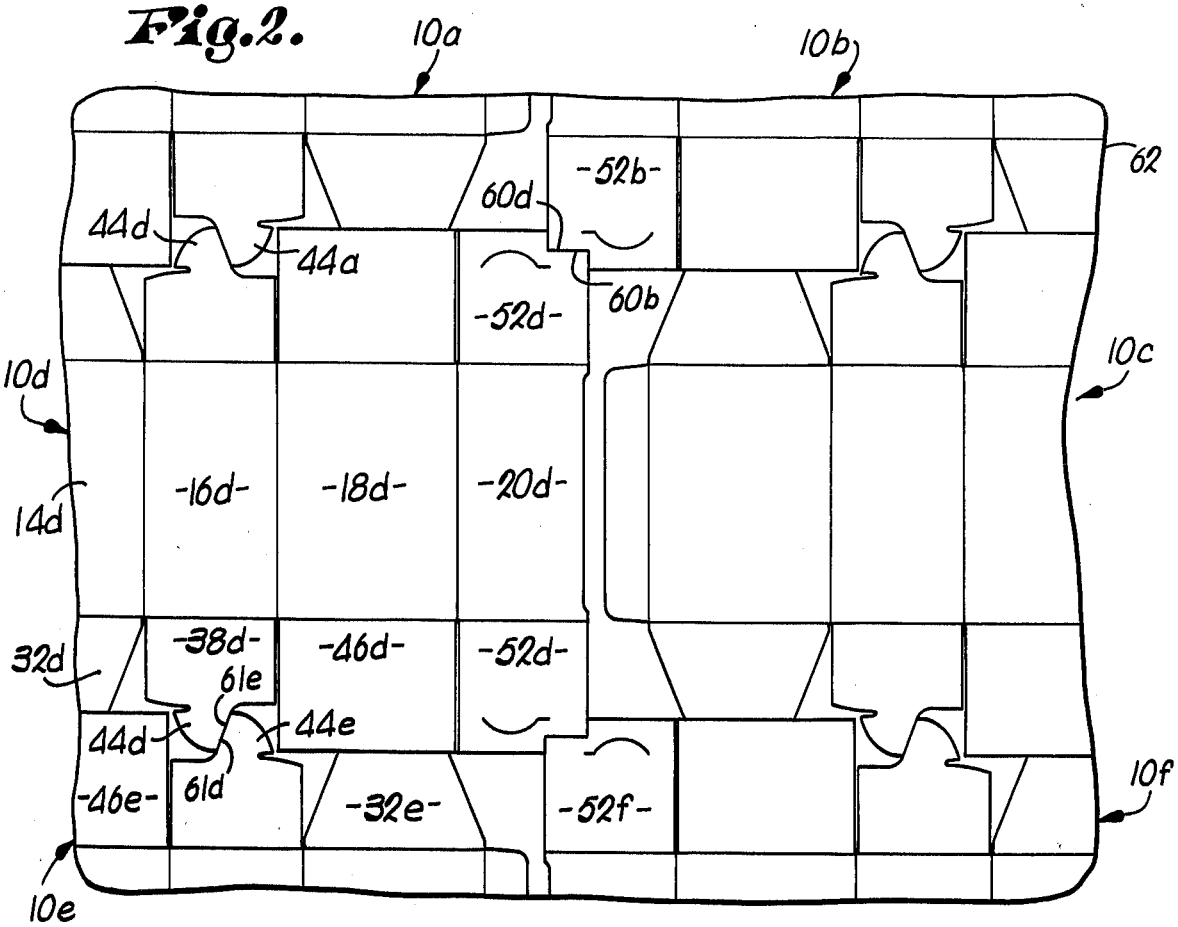

MATING BLANKS

"This is a continuation of application Ser. No. 693,365, filed on June 7, 1976, now has been abandoned."

This invention relates to an improved, low-cost carton blank for use in fabricating box-type cartons conventionally used for ice cream. More particularly, it is concerned with carton blanks which are especially configured to permit fabrication thereof from master sheets with substantial material savings, in order to lessen the cost of the resultant cartons.

A number of cartons and carton blanks have been proposed in the past for holding materials such as ice cream. Such carton blanks generally comprise a unitary sheet of waxed paper or similar material which presents a series of panel and flap sections interconnected along fold lines. These blanks are generally die cut and can be printed or otherwise decorated and folded to present box-like cartons having a shiftable top panel permitting access to the interior of the carton. Representative prior patents which disclose cartons and carton blanks of this variety are U.S. Pat. Nos. 3,206,099, 3,219,255, 2,246,484 and 3,539,093.

In the production of blanks to be used for ice cream cartons or the like, the common practice is to prepare an extremely large number thereof through automated techniques involving printing and die cutting a plurality of blanks from master sheets. In practice, the layout of the blanks onto the master sheets is extremely important in order to produce the greatest number of blanks per unit area of sheet material. In this regard, the cost of master sheet material is a prime component in the overall expense of the ice cream cartons, and accordingly any saving in this material can have a significant effect in terms of cost reduction.

Another problem heretofore encountered in the production of carton blanks of this type stems from the fact that it is not always possible to operate the printing machinery employed in the blank-making process at full capacity because of the layout of the blanks on the master sheet material, and the size of the master sheets. Therefore, any change in the configuration of the carton blank which would not only permit greater utilization of master sheet material but also allow fuller use of the blank-printing apparatus would represent a real savings to commercial fabricators.

It is also important that any change in carton blank design not detract from the usefulness of the resultant cartons. For example, conventional ice cream cartons are commonly filled with so-called "Anderson" filling machines, and any new carton should also be able to accommodate such preexisting filling equipment.

It is therefore the most important object of the present invention to provide a carton blank which is foldable to present a box-type carton adapted for filling with ice cream or the like using conventional filling equipment, and which is especially configured for permitting fabrication of a plurality of blanks from master sheet material with significant material savings and fuller use of printing equipment employed in the fabrication of the blanks.

Another object of the invention is to provide a carton blank of the type described which includes a unitary, die cut sheet of paperboard material which presents generally rectangular top, rear, bottom and front panel sections having oppositely extending marginal closure flaps, with the front panel closure flaps being configured to define outermost marginal relieved areas adapted to conform with corresponding relieved areas of identical blanks placed in catercorner relationship to the first blank, to thereby facilitate the layout of a plurality of blanks onto master sheets and in turn lessen the overall cost of the blanks; in preferred forms, the front panel closure flaps are die cut to present generally L-shaped relieved areas, but in other instances obliquely cut or scalloped outermost corners can be provided.

A still further object of the invention is to provide a carton blank especially adapted for the production of ice cream-type cartons and wherein the rearmost portions of the locking lobes of the male locking flaps thereof are relieved in a manner permitting side-by-side blanks to be placed in full abutting contact without interference from the locking lobes.

In the drawing

FIG. 1 is a plan view of the preferred carton blank in accordance with the invention;

FIG. 2 is a fragmentary plan view of a master sheet of material having a layout thereon of a plurality of carton blanks in accordance with the invention;

FIG. 3 is a fragmentary plan view of a pair of carton blanks arranged in catercorner relationship and having respective, oblique, conforming, outermost front panel closure flaps; and FIG. 4 is a fragmentary plan view of a pair of carton blanks arranged in catercorner relationship and having respective, conforming, scalloped outermost front panel closure flaps.

Turning now to the drawing, a carton blank 10 in accordance with the invention is depicted in plan in FIG. 1 and comprises a unitary sheet of material 12 which is configured to present substantially rectangular top, rear, bottom and front panels respectively labeled 14, 16, 18 and 20. The panels 14–20 are connected in order along a first series of mutually parallel fold lines 22, 24 and 26. In addition, a relatively narrow glue flap 28 is connected to the forwardmost edge of top panel 14 along a fold line 30 which is parallel with lines 22, 24 and 26.

Respective pairs of identical, oppositely extending closure flaps are connected to the opposed side margins of the panels 14–20 along respective longitudinally aligned fold lines which cooperatively present a second series of mutually parallel fold lines. In particular, a pair of generally trapezoidally shaped top panel closure flaps 32 are connected to opposite ends of panel 14 and are foldable along parallel fold lines 34 and 36. Adjacent rear panel closure flaps 38 connected along spaced fold lines 40 and 42 each include a generally rectangular body portion and an irregularly shaped, projecting male connection portion or locking lobe 44. Bottom panel closure flaps 46 are substantially rectangular in configuration and are connected to panel 18 along respective parallel fold lines 48 and 50. Finally, front panel closure flaps 52 are generally rectangular in configuration and connected to panel 20 along respective parallel fold lines 54 and 56. Each closure flap 52 includes a slotted female connection portion 58 which is adapted to lockably receive the corresponding adjacent male connection portion 44 of the proximal flap 38.

In addition, each closure flap 52 is configured to present a relieved outermost end margin denoted by the numeral 60. As will be explained in more detail hereinafter, each end margin 60 is configured and arranged to conform with the corresponding relieved end margin of an identical carton blank 10 when the blanks are placed in a catercorner relationship relative to each other.

It will also be seen that each locking lobe 44 is cut along rearmost edge line 61 in order to relieve the rear end of the lobe. In conventional cartons the locking lobes are of generally semicircular configuration which of course prevents juxtaposed blanks to be moved into full side-by-side abutment. However, it has been found that this conventional locking lobe can be modified as in the instant invention to present an essentially quartercircular configuration which permits a pair of the lobes (see FIG. 2) to abut along their respective rear edge lines and fit between the adjacent flaps 32 and 46.

In FIG. 2 a portion of a master sheet of material 62 is depicted which has the layout of six carton blanks 10*a*–10*f* thereon. Referring specifically to the juxtaposition of the layout of blanks 10*b* and 10*d* (which are in catercorner relationship), it will be seen that the respective relieved margins 60*b* and 60*d* conform with one another so that a single, irregular die cut would separate the blanks. A similar situation exists with respect to the relieved end margins of blanks 10*d* and 10*f*, as will be readily apparent. In addition, the configuration of the locking lobes 44*a*–44*f* is noteworthy in that it permits the most advantageous layout of the blanks. Referring to abutting blanks 10*d* and 10*e* for example, it will be noted that the respective lobes 44*d* and 44*e* are in engagement along the rear edge lines 61*d* and 61*e*, and that the lobes fit within the space defined by abutting pairs of flaps 32*d*, 46*e* and 32*e*, 46*d*.

It will be seen that the conformance between the front panel closure flaps of blanks 10*b*, 10*d* and 10*f* permits placement of the blank layout in a manner to efficiently utilize the sheet material 62. In this connection, it has been discovered that significant material savings can be achieved by providing the relieved front flap margins in accordance with the invention. Moreover, use of relieved flaps in the manner described permits fuller utilization of conventional printing equipment normally used in fabricating the carton blanks to further reduce costs.

Although the blank configuration illustrated in FIGS. 1 and 2 is preferred, the invention hereof is not so limited. Specifically, and referring to FIG. 3, a pair of conforming closure flaps 64 of another embodiment of the invention are illustrated. In this instance each flap 64 is configured to present a relieved outermost end margin which is obliquely or diagonally cut as at 66. Similarly, in FIG. 4 a pair of front closure flaps 68 of another embodiment are depicted, and in this case the outermost end margins of the flaps are of diagonally scalloped configuration as denoted by the numeral 70. The locking lobes 44 of the blanks may also be configured differently as long as side-by-side abutment of a pair of blanks is permitted.

In use, a bond or seal is created between flap 28 of blank 10 and it is attached to the external face of front panel 20 by folding the latter upwardly along line 26, and folding top panel 14 towards panel 20 which effects a sealing connection between flap 28 and panel 20. At this point blank 10 is a relatively flat, two-ply member that can be opened to present an elongated, open-ended element of rectangular cross-section. One end of this element is closed by folding together the opposed flaps 46 and 32 (flap 46 first), followed by folding together and interlocking flaps 38 and 52. The carton is then filled with ice cream from the remaining open end through the use of an Anderson filling machine, whereupon the filling end is closed to present a completed and filled carton.

Having thus described the invention, what is claimed as new and desired to be secured by Letters Patent is:

1. A carton blank, comprising:

a unitary sheet of material cut and configured to present substantially rectangular first, second, third and fourth panels connected in order along a first series of mutually parallel fold lines;

a pair of closure flaps respectively connected to the opposite ends of said first, second, third and fourth panels along mutually parallel marginal fold lines, with the flaps of each respective set thereof being substantially mirror images of one another, each of said third panel closure flaps being substantially rectangular in shape and having an outermost edge which is spaced a first distance from and parallel to the adjacent fold line along which the third panel closure flap is connected to the third panel, each of said second panel closure flaps being defined in part by an outermost cut line remote from said second panel which presents an outwardly projecting locking lobe and a recess between said locking lobe and the adjacent side edge of the proximal third panel closure flap, said locking lobe and recess being cooperatively configured and arranged such that, when a first blank identical to said blank is placed in oppositely disposed, side-by-side abutting relationship with the said blank, (1) the locking lobe of said blank is complementally received within the proximal recess of said first identical blank, (2) the proximal locking lobe of said first identical blank is complementally received within the adjacent recess of said blank, and (3) the outermost edges of the locking lobes of said blank and first identical blank are each located a second distance from the second panel of the adjacent blank, said second distance being less than said first distance whereby the respective locking lobes each extend into the recess of the adjacent blank, said fourth panel closure flaps each having locking means thereon for receiving the locking lobe of the adjacent second panel closure flap, and being defined in part by a cut line remote from said fourth panel and the adjacent third panel closure flap, said last-mentioned cut line being configured and arranged to present an abutment edge for complementally abutting the abutment edge of a second identical blank placed in catercorner relationship with said blank, with the fourth panel of said blank being proximal to the fourth panel of said second identical blank.

2. The carton blank as set forth in claim 1 wherein the cut line partially defining each of said fourth panel closure flaps is generally L-shaped in configuration.

3. The carton blank as set forth in claim 1 wherein the cut line partially defining each of said fourth panel closure flaps is scalloped in configuration.

4. The carton blank as set forth in claim 1 wherein the cut line partially defining each of said fourth panel closure flaps is obliquely oriented.

5. The carton blank as set forth in claim 1 including a glue-flap connected to said top panel along a fold line parallel with said first series of fold lines.

6. The carton blank as set forth in claim 1 wherein said locking means on each of said fourth panel closure flaps comprises a lobe-receiving opening.

7. The carton blank as set forth in claim 1 wherein said first panel closure flaps are generally trapezoidal in configuration.

* * * * *